US009777742B2

(12) United States Patent
Yang et al.

(10) Patent No.: US 9,777,742 B2
(45) **Date of Patent: *Oct. 3, 2017**

(54) CENTRIFUGAL FAN IMPELLER STRUCTURE

(71) Applicant: ASIA VITAL COMPONENTS CO., LTD., Sinjhuang District, New Taipei (TW)

(72) Inventors: Chih-Wei Yang, New Taipei (TW); Sheng-Pei Lee, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 888 days.

This patent is subject to a terminal disclaimer.

(21) Appl. No.: 13/669,446

(22) Filed: Nov. 6, 2012

(65) Prior Publication Data

US 2014/0127029 A1 May 8, 2014

(51) Int. Cl.

| | |
|---|---|
| ***F04D 29/28*** | (2006.01) |
| ***F04D 29/66*** | (2006.01) |
| ***F04D 29/22*** | (2006.01) |

(52) U.S. Cl.

CPC ..... *F04D 29/281* (2013.01); *F04D 29/2216* (2013.01); *F04D 29/666* (2013.01)

(58) Field of Classification Search

CPC .... F04D 29/2216; F04D 29/66; F04D 29/661; F04D 29/666; F04D 17/162; F04D 29/281; F04D 29/30; F05D 2240/304; G06F 1/203

See application file for complete search history.

(56) References Cited

U.S. PATENT DOCUMENTS

| | | | | |
|---|---|---|---|---|
| 2,227,373 | A * | 12/1940 | Behrens | 415/144 |
| 4,253,800 | A * | 3/1981 | Segawa | F01D 5/10 415/119 |
| 4,662,830 | A * | 5/1987 | Pottebaum | 417/424.1 |
| 4,923,365 | A * | 5/1990 | Rollwage | 415/119 |
| 5,026,251 | A * | 6/1991 | Kinoshita et al. | 415/119 |
| 5,681,145 | A * | 10/1997 | Neely et al. | 416/203 |
| 6,340,291 | B1 * | 1/2002 | Reckert | 416/185 |
| 6,488,472 | B1 * | 12/2002 | Miyazawa | 416/144 |
| 6,579,064 | B2 * | 6/2003 | Hsieh | 416/182 |
| 7,300,244 | B2 * | 11/2007 | Baugh et al. | 415/119 |
| 7,597,541 | B2 * | 10/2009 | White | 416/183 |
| 8,221,069 | B2 * | 7/2012 | Ogino | F04D 29/282 415/206 |
| 2007/0140832 | A1 * | 6/2007 | Chiang et al. | 415/72 |
| 2008/0247868 | A1 * | 10/2008 | Lan et al. | 415/182.1 |

* cited by examiner

*Primary Examiner* — Dwayne J White
*Assistant Examiner* — Adam W Brown
(74) *Attorney, Agent, or Firm* — C. G. Mersereau; Nikolai & Mersereau, P.A.

(57) ABSTRACT

A centrifugal fan impeller structure includes a hub having multiple blades. The blades extend from a circumference of the hub in a direction away from the hub. Each two adjacent blades define therebetween a flow way, an air outlet and an air inlet. The air outlet and the air inlet are respectively positioned at two ends of the flow way in communication with the flow way. The air outlets are arranged at unequal intervals so as to greatly reduce noise in operation.

3 Claims, 4 Drawing Sheets

CENTRIFUGAL FAN IMPELLER STRUCTURE

BACKGROUND OF THE INVENTION

1. Field of the Invention

The present invention relates generally to an improved centrifugal fan impeller structure, and more particularly to a centrifugal fan impeller structure, which can reduce noise in operation of the centrifugal fan.

2. Description of the Related Art

Along with the rapid development of electronic industries, the performance of the electronic components has been more and more enhanced. The electronic components have operated at higher and higher speed. In the meantime, the heat generated by the electronic components has become higher and higher. In case the heat is not dissipated in time, the operation performance of the electronic components will be deteriorated. In some more serious cases, the electronic components may even burn out. In order to dissipate the heat, a miniaturized centrifugal fan is installed in a limited space of the system for carrying away the heat. The centrifugal fan includes a frame body, a fan hub and multiple blades annularly disposed around outer circumference of the fan hub. Each of upper and lower sides of the frame body is formed with an air inlet. A lateral side of the frame body is formed with an air outlet. In operation, the blades rotate to drive the ambient air to flow. The axial airflow going into the frame body from the air inlet is turned to radial airflow, which is exhausted from the air outlet.

When the centrifugal fan operates, the non-uniform wake flowing out from the fan impeller will interact with the tongue to make noise. In the case that the gap between the fan impeller and the tongue is relatively narrow, the noise will be affected by the tongue oscillation caused by the impact of the non-uniform wake onto the tongue and the pressure difference around the tongue. In the case that the gap is 20% the radius of the fan impeller, only the non-uniform wake will affect the major noise source and the non-uniform wake only has little affection on the major noise source. In addition, the wake strength can be lowered by means of adding short vanes between the blades. This can minimize the affection of the non-uniform wake on the pressure turbulence and the noise. According to the above, the conventional centrifugal fan has the following shortcomings:

1. The structural design is limited.
2. The conventional centrifugal fan cannot be flexibly designed according to the characteristics.
3. The noise is loud.

SUMMARY OF THE INVENTION

It is therefore a primary object of the present invention to provide an improved centrifugal fan impeller structure, which can reduce noise.

To achieve the above and other objects, the centrifugal fan impeller structure of the present invention includes a hub having multiple blades. The blades extend from a circumference of the hub in a direction away from the hub. Each two adjacent blades define therebetween a flow way, an air outlet and an air inlet. The air outlet and the air inlet are respectively positioned at two ends of the flow way in communication with the flow way. The air outlets between the blades are selectively arranged at unequal intervals. This can lower the single tone of the blade passing frequency (BPF) and increase the blade passing frequency (BPF) and lower sound pressure weighting so as to greatly reduce noise. In addition, the blade structure can be more flexibly designed according to the boundary condition.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
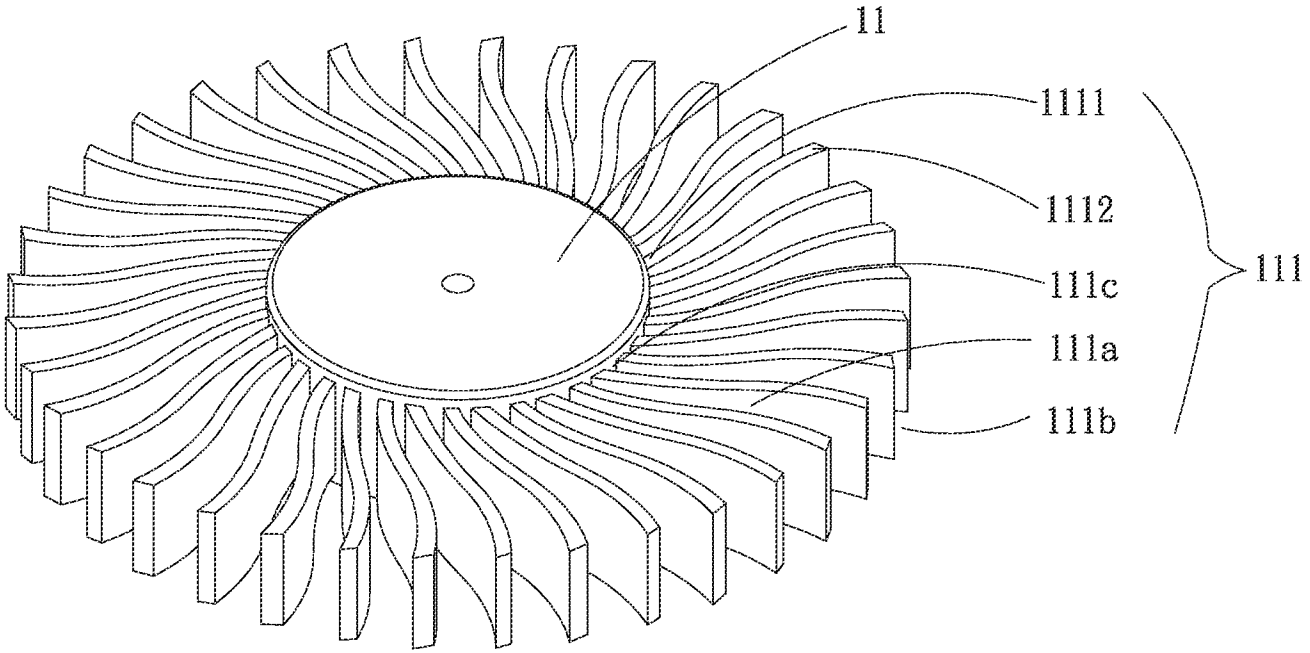
FIG. 1 is a perspective view of a first embodiment of the centrifugal fan impeller structure of the present invention.
Figure 2:
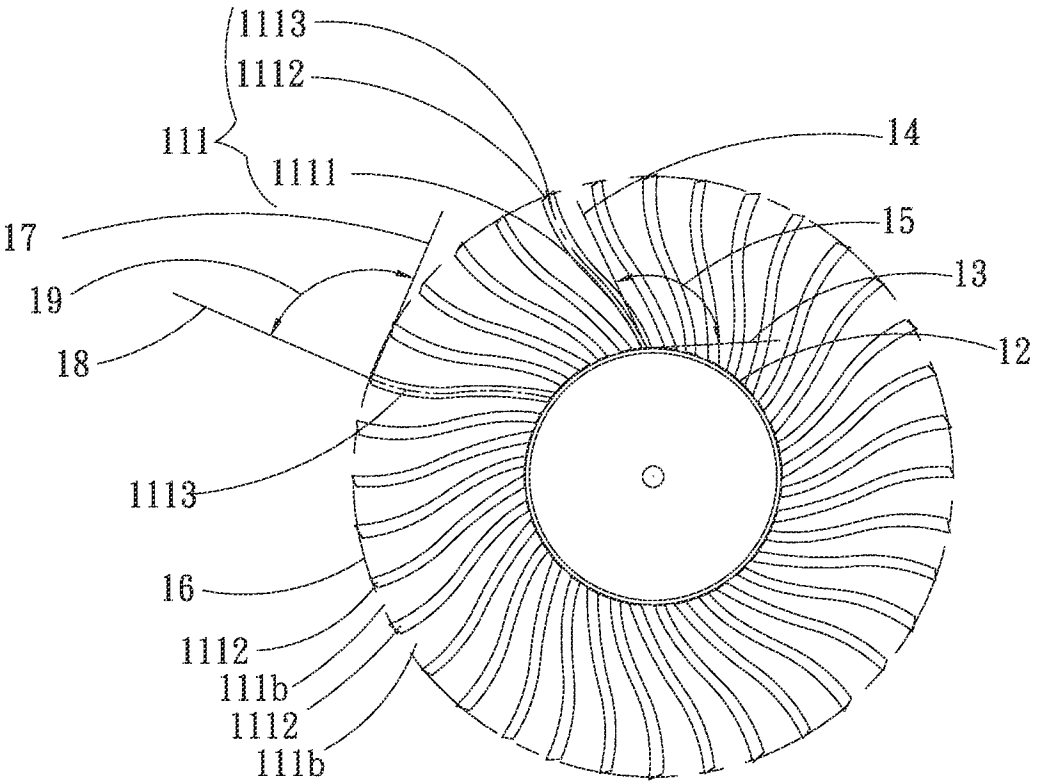
FIG. 2 is a top view of the first embodiment of the centrifugal fan impeller structure of the present invention.

Please refer to FIGS. 1 and 2. FIG. 1 is a perspective view of a first embodiment of the centrifugal fan impeller structure of the present invention. FIG. 2 is a top view of the first embodiment of the centrifugal fan impeller structure of the present invention. According to the first embodiment, the centrifugal fan impeller structure of the present invention includes a hub 11 having multiple blades 111 with generally similar curved shapes.

The blades 111 extend from a circumference of the hub 11 in a direction away from the hub 11. Each two adjacent blades 111 define therebetween a flow way 111*a*, an air outlet 111*b* and an air inlet 111*c*. The air outlet 111*b* and the air inlet 111*c* are respectively positioned at two ends of the flow way 111*a* in communication with the flow way 111*a*. The air outlets 111*b* are arranged at unequal intervals.

Each blade 111 has a first end 1111 and a second end 1112. The air inlet 111*c* is defined between the first ends 1111 of each two adjacent blades 111. The air outlet 111*b* is defined between the second ends 1112 of each two adjacent blades 111.

The first ends 1111 together define a first pitch circle 12. A tangent of the first pitch circle 12 at the first end 1111 is defined as a first tangent 13. The blade 111 has a blade central line 1113. A tangent of the blade central line 1113 at the first end 1111 is defined as a second tangent 14. The second tangent 14 intersects the first tangent 13 to contain an air incoming angle 15.

The second ends 1112 together define a second pitch circle 16. A tangent of the second pitch circle 16 at the second end 1112 is defined as a third tangent 17. A tangent of the blade central line 1113 at the second end 1112 is defined as a fourth tangent 18. The fourth tangent 18 intersects the third tangent 17 to contain an air outgoing angle 19. In this embodiment, the second ends 1112 have unequal widths.

That is, the blades 111 with two different widths are alternately annularly disposed on the circumference of the hub 11, whereby the air outlets 111*b* are arranged at unequal intervals.

Figure 3:
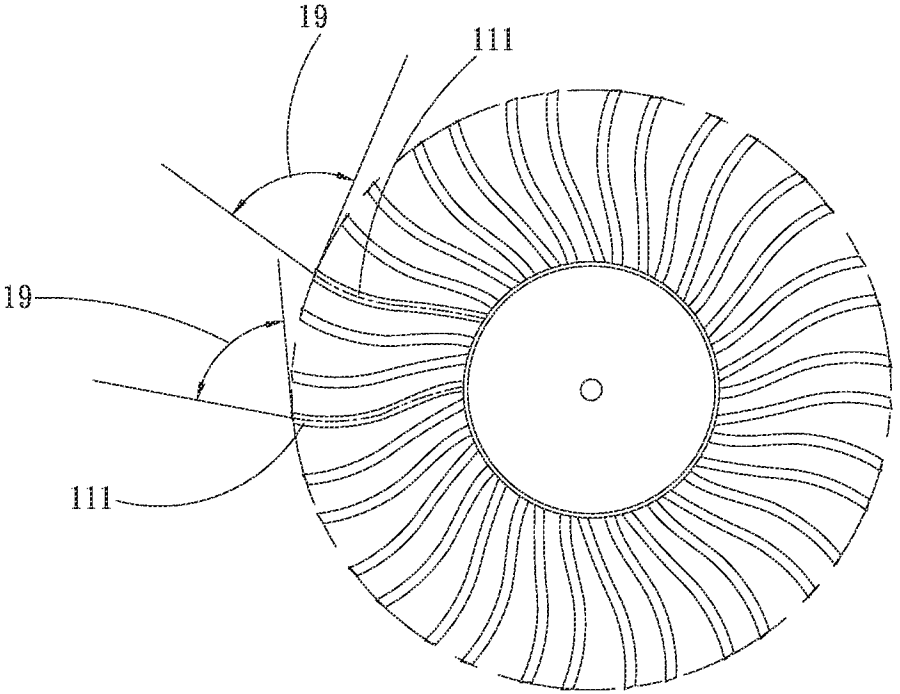
FIG. 3 is a top view of a second embodiment of the centrifugal fan impeller structure of the present invention.

Please now refer to FIG. 3, which is a top view of a second embodiment of the centrifugal fan impeller structure of the present invention. The second embodiment is partially identical to the first embodiment in structure and thus will not be repeatedly described hereinafter. The second embodiment is different from the first embodiment in that the air outgoing angles 19 are unequal. That is, the air outgoing angles 19 of at least two blades 111 are unequal to each other. The blades 111 with two different air outgoing angles 19 can be alternately annularly disposed on the circumference of the hub 11.

Figure 4:
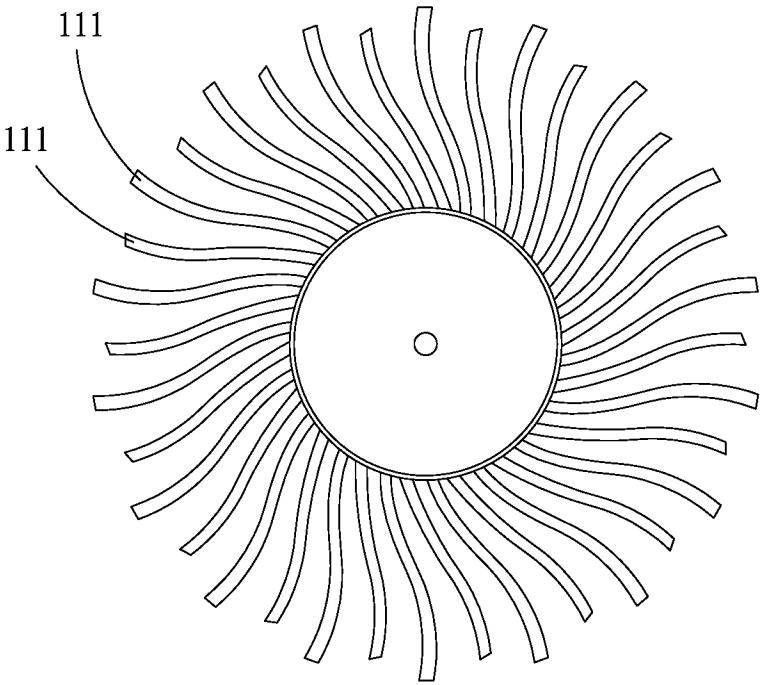
FIG. 4 is a top view of a third embodiment of the centrifugal fan impeller structure of the present invention.

Please now refer to FIG. 4, which is a top view of a third embodiment of the centrifugal fan impeller structure of the present invention. The third embodiment is partially identical to the first embodiment in structure and thus will not be repeatedly described hereinafter. The third embodiment is different from the first embodiment in that at least one of the blades 111 has a length unequal to that of the other blades 111.

The present invention has been described with the above embodiments thereof and it is understood that many changes and modifications in the above embodiments can be carried out without departing from the scope and the spirit of the invention that is intended to be limited only by the appended claims.

What is claimed is:

1. A centrifugal fan impeller structure comprising:

a hub having multiple blades, each of the blades having one end connected with a circumference of the hub and extending from the circumference of the hub in a direction away from the hub, another end of each of the blades being a free end and each two adjacent blades defining therebetween a flow way, an air outlet and an air inlet, the air outlet and the air inlet being respectively positioned at two ends of the flow way in communication with the flow way, the air outlets being arranged at unequal intervals;

wherein each blade has a first end and a second end, the air inlet being defined between the first ends of each two adjacent blades, the air outlet being defined between the second ends of each two adjacent blades;

wherein the first ends together define a first pitch circle, a tangent of the first pitch circle at the first end being defined as a first tangent, the blade having a blade central line, a tangent of the blade central line at the first end being defined as a second tangent, the second tangent intersecting the first tangent to contain an air incoming angle;

wherein the second ends together define a second pitch circle, a tangent of the second pitch circle at the second end being defined as a third tangent, the blade having a blade central line, a tangent of the blade central line at the second end being defined as a fourth tangent, the fourth tangent intersecting the third tangent to contain an air outgoing angle, the air outgoing angles of the blades being unequal; and wherein the air outlets at the free ends of the blades are arranged un-equidistantly; and wherein the blades have a similar curved shape, and the first ends of the blades have equal widths.

2. The centrifugal fan impeller structure as claimed in claim 1, wherein the second ends have unequal widths.

3. A centrifugal fan impeller structure comprising:

a hub having multiple blades, each of the blades having one end connected with a circumference of the hub and extending from the circumference of the hub in a direction away from the hub, another end of each of the blades being a free end and each two adjacent blades defining therebetween a flow way, an air outlet and an air inlet, the air outlet and the air inlet being respectively positioned at two ends of the flow way in communication with the flow way, the air outlet being arranged at unequal intervals;

wherein each blade has a first end and a second end, the air inlet being defined between the first ends of each two adjacent blades, the air outlet being defined between the second ends of each two adjacent blades;

wherein the first ends together define a first pitch circle, a tangent of the first pitch circle at the first end being defined as a first tangent, the blade having a blade central line, a tangent of the blade central line at the first end being defined as a second tangent, the second tangent intersecting the first tangent to contain an air incoming angle;

wherein the second ends together define a second pitch circle, a tangent of the second pitch circle at the second end being defined as a third tangent, the blade having a blade central line, a tangent of the blade central line at the second end being defined as a fourth tangent, the fourth tangent intersecting the third tangent to contain an air outgoing angle;

wherein the air outlets at the free ends of the blades are arranged un-equidistantly;

wherein the blades have a similar curved shape, and the first ends of the blades have equal widths; and wherein at least one of the blades has a length unequal to that of the other blades.

* * * * *